US008584318B1

(12) United States Patent
Tu

(10) Patent No.: US 8,584,318 B1
(45) Date of Patent: Nov. 19, 2013

(54) DOOR HINGE WITH QUICK REMOVAL STRUCTURE

(76) Inventor: Chih-Feng Tu, New Taipei (TW)

( * ) Notice: Subject to any disclaimer, the term of this patent is extended or adjusted under 35 U.S.C. 154(b) by 0 days.

(21) Appl. No.: 13/562,342

(22) Filed: Jul. 31, 2012

(51) Int. Cl.
*E05D 7/10* (2006.01)

(52) U.S. Cl.
USPC ..... 16/262; 16/380; 16/263

(58) Field of Classification Search
USPC ..... 16/260, 261, 262, 263, 265, 380, 386; 403/108, 154, 155, 322.2, 322.3
See application file for complete search history.

(56) References Cited

U.S. PATENT DOCUMENTS

| | | | | | |
|---|---|---|---|---|---|
| 1,457,964 | A * | 6/1923 | Doty | 33/512 |
| 1,979,894 | A * | 11/1934 | Lyons | 16/263 |
| 2,772,441 | A * | 12/1956 | Riser | 16/276 |
| 2,817,871 | A * | 12/1957 | Chamberlain | 16/381 |
| 2,937,399 | A * | 5/1960 | De Vore | 16/263 |
| 3,015,867 | A * | 1/1962 | Bronstein et al. | 403/182 |
| 3,188,686 | A * | 6/1965 | Orcutt | 16/263 |
| 3,744,085 | A * | 7/1973 | Griego | 16/325 |
| 3,869,752 | A * | 3/1975 | Klay | 16/234 |
| 3,926,382 | A * | 12/1975 | Sieurin et al. | 242/362 |
| 4,137,603 | A * | 2/1979 | Kvasnes | 16/381 |
| 5,040,268 | A * | 8/1991 | Knurr | 16/261 |
| 5,586,363 | A * | 12/1996 | Fanuzzi | 16/342 |
| 5,820,288 | A * | 10/1998 | Cole | 403/97 |
| 5,930,867 | A * | 8/1999 | Grzeskowiak | 16/244 |
| 5,966,778 | A * | 10/1999 | Ray | 16/374 |
| 6,701,573 | B1 * | 3/2004 | Ciavarella et al. | 16/266 |
| 7,603,746 | B1 * | 10/2009 | von Resch et al. | 16/245 |
| 7,805,811 | B2 * | 10/2010 | Shuker | 16/380 |
| 8,359,709 | B2 * | 1/2013 | Van Gennep | 16/328 |

* cited by examiner

*Primary Examiner* — Chuck Mah
(74) *Attorney, Agent, or Firm* — Schmeiser, Olsen & Watts LLP

(57) ABSTRACT

A door hinge with a quick removal structure includes a first body, a second body, a bushing, a pivot and a ball. A first socket and a second socket are coupled to the first body and the second body respectively, and a first slide groove is formed on an inner wall of the first socket. The connection and separation of the first body with the second body can be determined by the control of the position of the ball to set the status of the door hinge and achieve the quick removal effect.

5 Claims, 7 Drawing Sheets

DOOR HINGE WITH QUICK REMOVAL STRUCTURE

FIELD OF TECHNOLOGY

The present invention relates to a removable structure, in particular to a door hinge with a quick removal structure.

BACKGROUND

Door is intended for blocking the interconnection of two spaces when closed and communicating the two spaces when opened. Therefore, a door hinge is generally used as a rotating axis for opening and closing the door, regardless of an anti-theft door, a refrigerator door or any other door.

If a person is locked in an interior space such as a bathroom or a bedroom, the person requires a key to open a door lock or asks somebody outside to help opening the door in order to leave the interior space successfully. However, if the person locked in the interior space has no key and fails to contact other person to help opening the door, the person has to break the door lock or exit from a window to leave the interior space. If the person chooses to break the door lock, it may take a relatively long time but still fails to open the door, and it is very likely to have a need to change the door lock. If the person chooses to exit the interior space from a window, there is a risk of falling, getting injured, or even jeopardizing the person's life. Therefore, it is an issue for related manufacturers and designers to overcome the aforementioned problems.

In view of the drawbacks of the conventional door, the inventor of the present invention based on years of experience in the related industry to conduct extensive researches and experiments, and finally developed a quick removal structure with a simple design to overcome the problems of the prior art.

SUMMARY

Therefore, it is a primary objective of the present invention to provide a door hinge with a quick removal structure to achieve the quick removal effect.

To achieve the aforementioned and other objectives, the present invention provides a door hinge with a quick removal structure, connected between a door and a wall, comprising: a first body, integrally coupled to a first socket, and having a first slide groove formed on an inner wall of the first socket; a second body, integrally coupled to a second socket; a bushing, passed into the first socket and the second socket, and having a through hole formed on a surface of the bushing; a pivot, passed into the bushing and having a notch formed on a surface of the pivot; and a ball; wherein when the ball is situated in the first slide groove and the through hole, the first body and the second body are pivotally and integrally coupled to one another; and when the ball is separated from the first slide groove and disposed in the through hole and the notch, the pivot and the bushing can be separated from the first socket and the second socket, so that the first body and the second body are separated from each other.

The objects, characteristics and effects of the present invention will become apparent with the detailed description of the preferred embodiments and the illustration of related drawings as follows.

DETAILED DESCRIPTION

Figure 1:
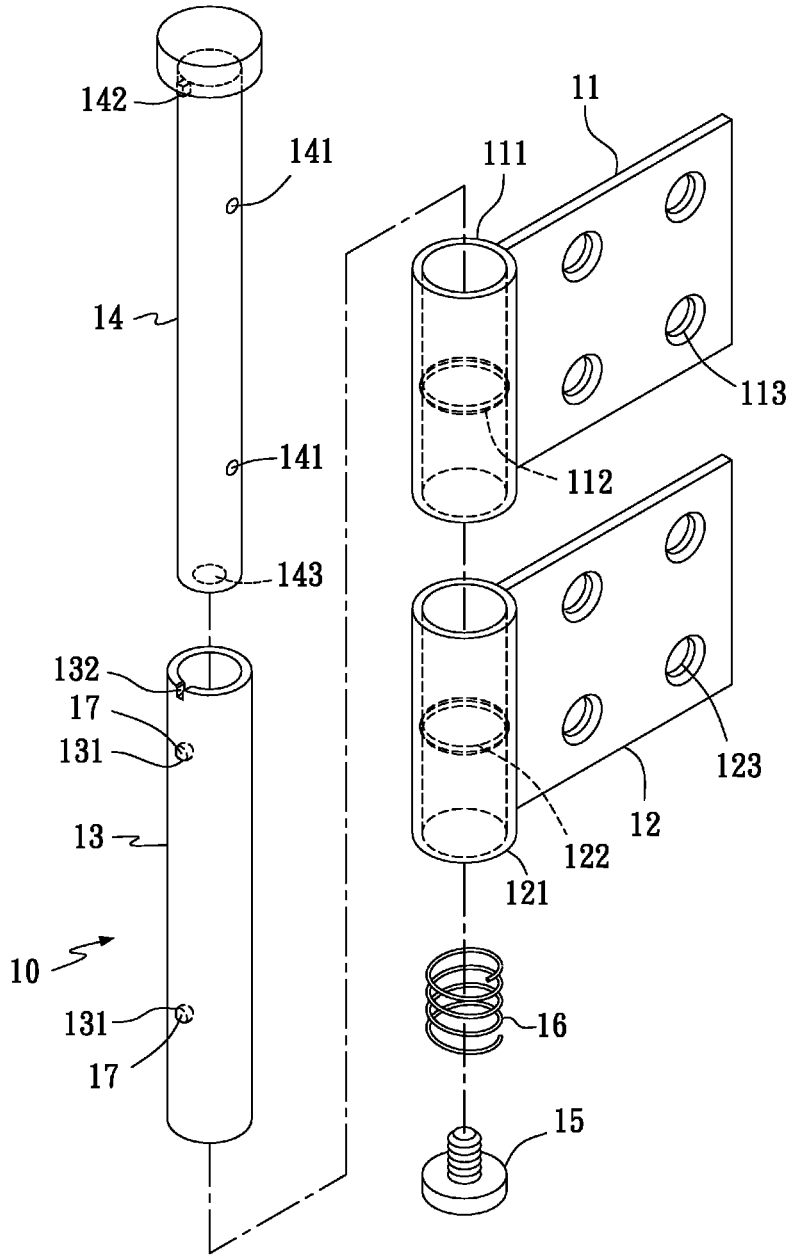
FIG. 1 is an exploded view of a door hinge with a quick removal structure of the present invention.
Figure 2:
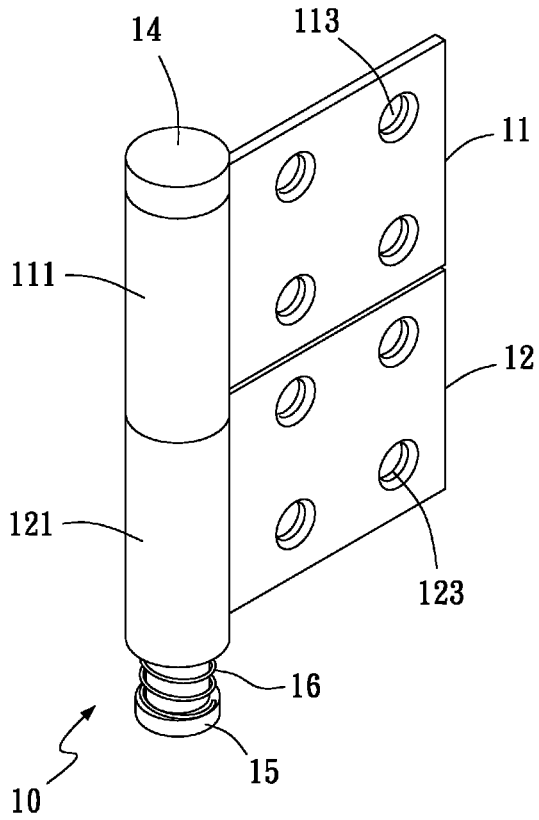
FIG. 2 is a perspective view of a door hinge with a quick removal structure of the present invention.
Figure 3:
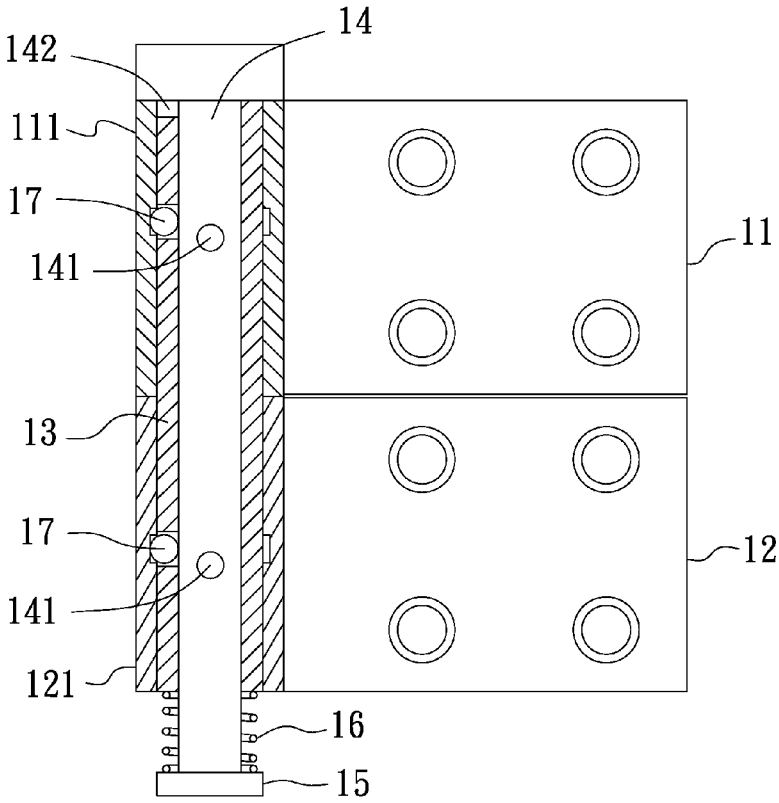
FIG. 3 is a cross-sectional side view of a door hinge with a quick removal structure of the present invention.
Figure 4:
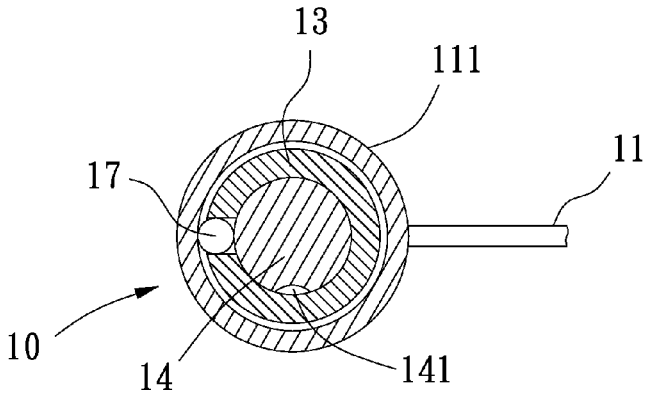
FIG. 4 is a top view of a door hinge with a quick removal structure of the present invention.
Figure 5:
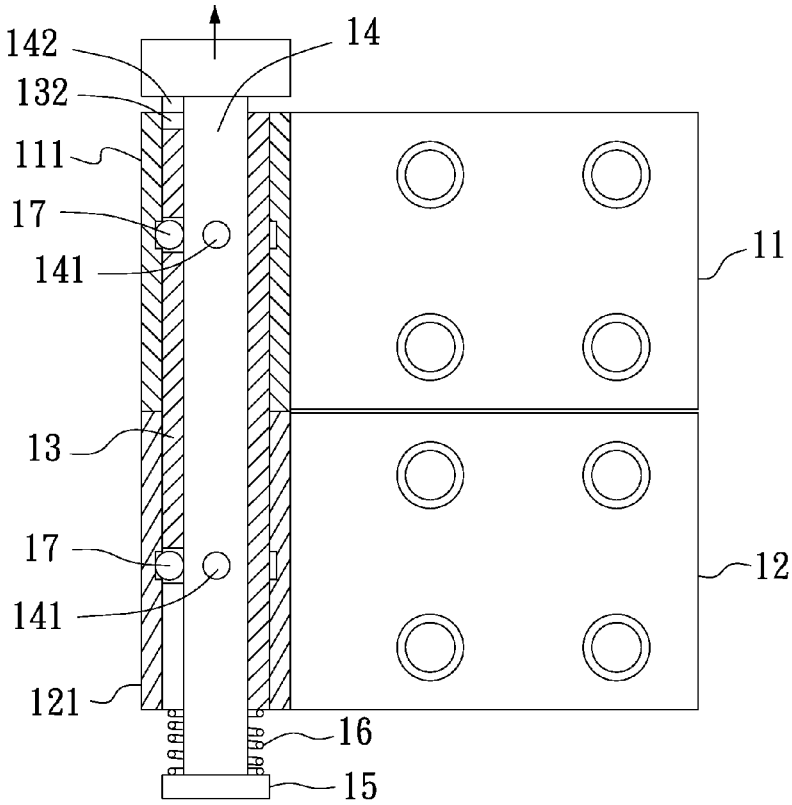
FIG. 5 is a schematic view of motions of a door hinge with a quick removal structure of the present invention.
Figure 6:
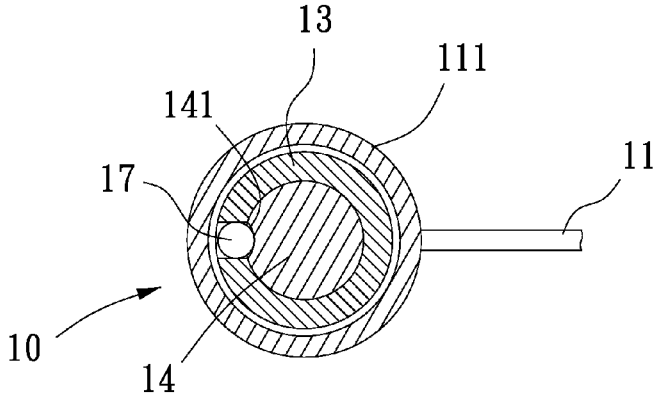
FIG. 6 is a schematic view of motions of a door hinge with a quick removal structure of the present invention.
Figure 7:
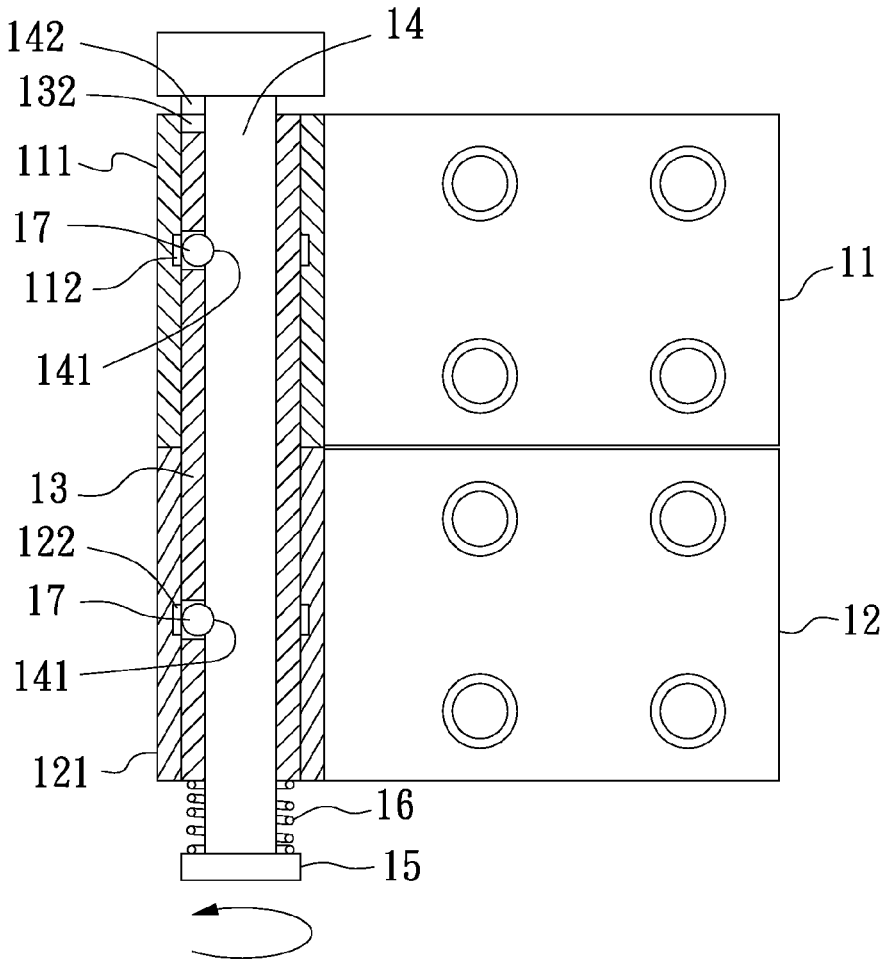
FIG. 7 is a schematic view of motions of a door hinge with a quick removal structure of the present invention.
Figure 8:
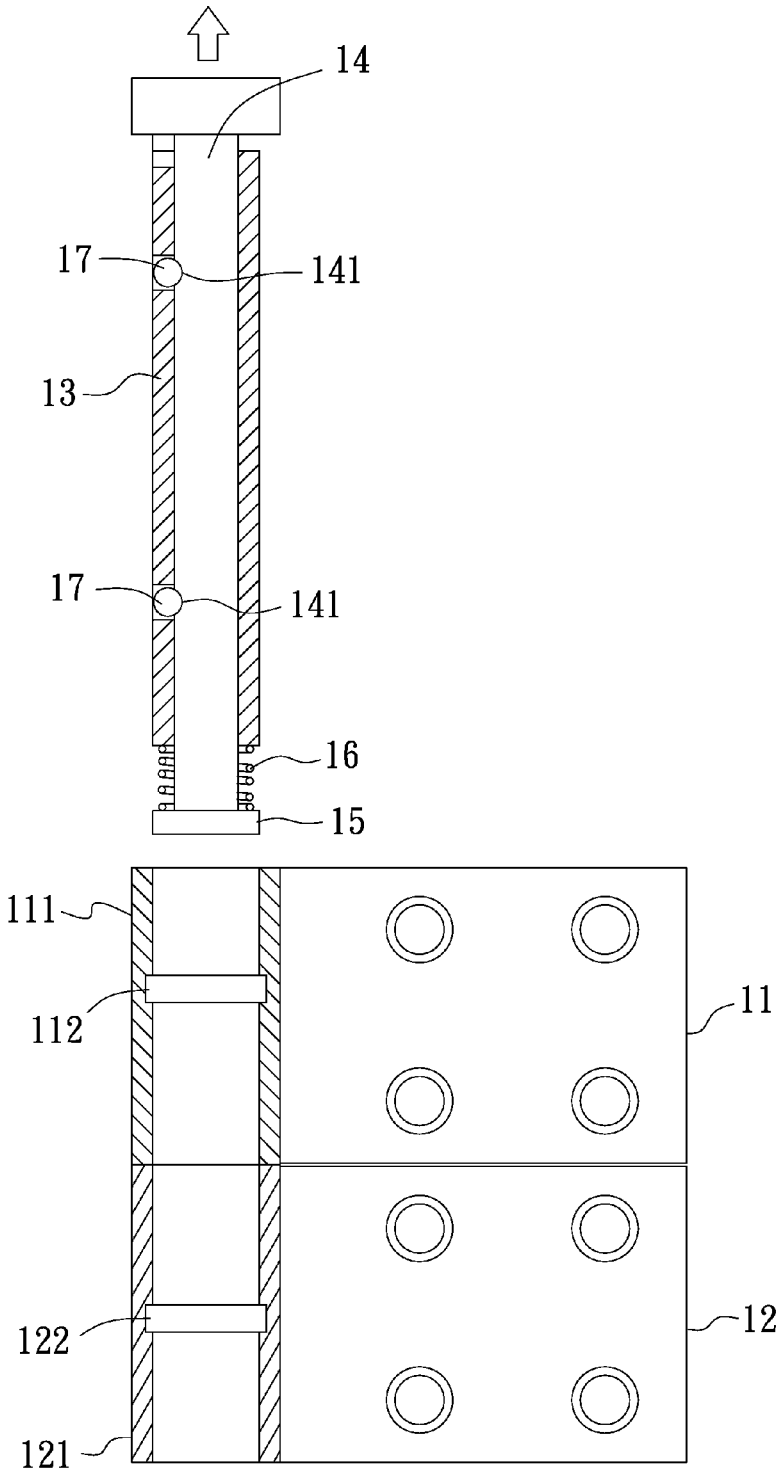
FIG. 8 is a schematic view of motions of a door hinge with a quick removal structure of the present invention.
Figure 9:
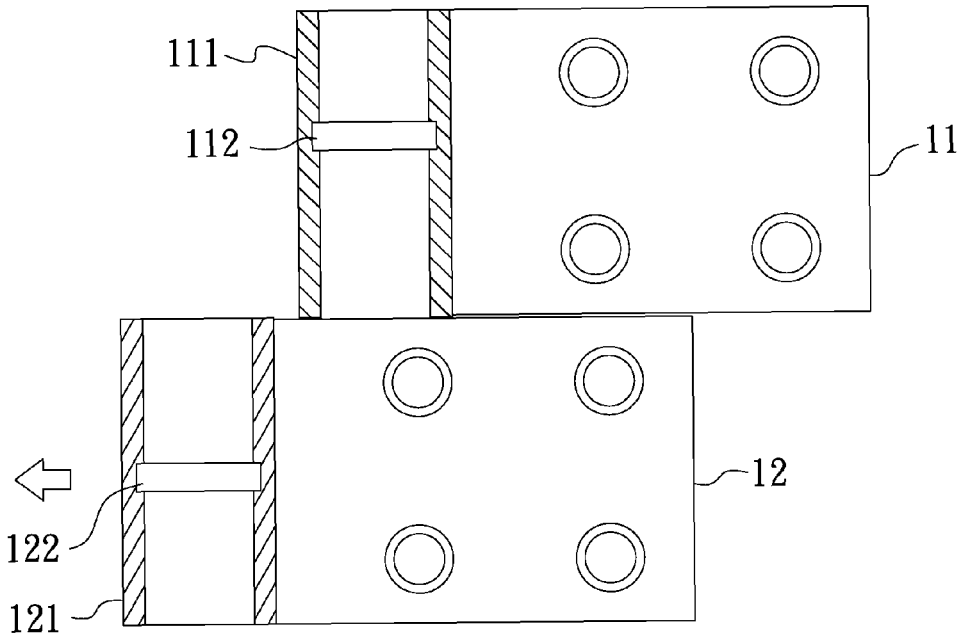
FIG. 9 is a schematic view of motions of a door hinge with a quick removal structure of the present invention.

With reference to FIGS. 1 to 4 for an exploded view, a perspective view, cross-sectional side view and a top view of a door hinge with a quick removal structure of the present invention respectively, the door hinge with a quick removal structure 10 comprises a first body 11, a second body 12, a bushing 13, a pivot 14 and a ball 17. The first body 11 and the second body 12 include a first socket 111 and a second socket 121 coupled to the first body 11 and the second body 12 respectively, and the first socket 111 has a first slide groove 112 formed on an inner wall of the first socket 111. The bushing 13 is passed into the first socket 111 and the second socket 121, and a through hole 131 is formed on a surfaced of the busing 13. The pivot 14 is passed into the bushing 13 and a notch 141 is formed on a surface of the pivot 14. When the ball 17 is situated in the first slide groove 112 and the through hole 131, the first body 11 and the second body 12 are pivotally and integrally coupled to each other.

The first body 11 of the door hinge with a quick removal structure 10 has a plurality of fixing holes 113 corresponding to a plurality of fixtures (not shown in the figure) and fixed onto a wall (not shown in the figure), and the second body 12 is fixed onto a door (not shown in the figure) through the plurality of fixtures (not shown in the figure) on the plurality of fixing holes 12. Since the first body 11 and the second body 12 are pivotally coupled together through the first socket 111, the second socket 121, the pivot 14 and the bushing 13, therefore they can assist users to open or close the door.

To enhance the stability of the overall structure, a first slide groove 112 and a second slide groove 122 are formed on inner walls of the first socket 111 and the second socket respectively, and a through hole 131 is formed on a surface of the bushing 13 and corresponding to the first slide groove 112 and the second slide groove 122, and a notch 141 is formed at a surface of the pivot 14 and corresponding to the through hole 131. Therefore, a ball 17 is installed into each through hole 131 of the sets of first slide grooves 112/second slide grooves 122 separately, so that the weight of the door (not shown in the figure) is uniformly distributed on the ball 17 to achieve the effects of enhancing the overall structure and preventing the first body 11 and the second body 12 from separating from each other.

To link and rotate the bushing 13 and the pivot 14 when opening or closing the door (not shown in the figure), a breach 132 is formed at the top end of the bushing 13, and a bump 142 is formed at the top of the pivot 14, and the bump 142 can be latched into the breach 132, so that the bushing 13 and the pivot 14 can be linked and rotated.

In addition, the door hinge with a quick removal structure further comprises a locking element 15 and an elastic element 16, and a lock hole 143 is formed at the bottom of the pivot 14. The locking element 15 and the lock hole 143 are integrally locked and the elastic element 16 is covered onto the pivot 14 and abutted against a position between the bottom edge of the bushing 13 and the locking element 15. Therefore, the elastic restoration of the elastic element 16 forces the bump 142 to be latched into the breach 132 securely.

With reference to FIGS. 5 to 9 for schematic views of motions of a door hinge with a quick removal structure in accordance with the present invention respectively as well as FIG. 1, when it is necessary to remove the door hinge with a quick removal structure 10, users need to push the pivot 14 upward through the locking element 15, so that the bump 142 is separated from the breach 132, and the pivot 14 and the bushing 13 are no longer linked. And then, the pivot 14 is turned to interconnect the notch 141, the first slide groove 112 and the through hole 131 (wherein the interconnected channel is aligned slightly inward and tilted downward). Now, the ball 17 will be separated from the first slide groove 112 automatically and rolled to the positions of the through hole 131 and the notch 141 correspondingly. Therefore, the pivot 14 and the bushing 13 can be separated from the first socket 111 and the second socket 121, and the first body 11 and the second body 12 are separated from one another.

If a person locks himself/herself in the interior space and the person does not have a key or fails to contact any other person to help opening the door, the person will be able to separate the door (not shown in the figure) from the wall (not shown in the figure) through the aforementioned method. In other words, the door can be removed from the wall without requiring any tool, damaging a door lock, or exiting from a window. The person can leave the space successfully and conveniently.

If it is necessary to re-install the door hinge with a quick removal structure 10, the users simply need to insert the pivot 14 and the bushing 13 into the first socket 111 and the second socket 121 and adjust the positions of the notch 141, the first slide groove 112 and the through hole 131 to interconnect them, and then turn the pivot 14, so that the edge of the notch 141 will push the ball 17 back to the positions of the first slide groove 112 and the through hole 131, and the bump 142 will be latched into the breach 132 to complete the installation. Obviously, the operation is simple and easy.

In summation of the description above, the design of the door hinge with a quick removal structure in accordance with the present invention is feasible and overcomes the drawbacks of the prior art and complies with patent application requirements, and is thus duly file for patent application.

While the invention has been described by means of specific embodiments, numerous modifications and variations such as the up-and-down relation of the first body 11 and the second body 12 and the connection between the wall and the door could be made thereto by those skilled in the art without departing from the scope and spirit of the invention set forth in the claims.

What is claimed is:

1. A door hinge with a quick removal structure, adapted to be coupled between a door and a wall, comprising:

a first body, integrally coupled to a first socket, and having a first annular slide groove formed on an inner surface of the first socket;

a second body, integrally coupled to a second socket;

a bushing, passing into the first socket and the second socket, and having a through hole formed between an outer surface and an inner surface of the bushing;

a pivot, passing into the bushing, and having a notch formed on a surface of the pivot;

and a ball received in the through hole of the bushing and being movable between a locking position and a release position;

wherein, when the ball is in the locking position, said ball engages the first annular slide groove and the through hole, thereby the axial movement of the bushing relative to the first socket is prevented and the first body and the second body are integrally and pivotally coupled to each other; and when the ball is in the release position, said ball is separated from the first slide groove and engages the through hole and the notch of the pivot, thereby the pivot and the bushing is detachable from the first socket and the second socket, and the first body and the second body are separated from one another.

2. The door hinge with a quick removal structure according to claim 1, wherein the bushing has a breach formed at the top end of the bushing, and the pivot has a bump disposed at the top of the pivot and latched into the breach, so that the bushing and the pivot can be linked and rotated together.

3. The door hinge with a quick removal structure according to claim 2, further comprising a locking element and an elastic element, and a lock hole formed at the bottom of the pivot, and the locking element and the lock hole being integrally locked with one another, and the elastic element being covered onto the pivot and abutted against a position between the bottom edge of the bushing and the locking element to force the bump to be latched into the breach securely.

4. The door hinge with a quick removal structure according to claim 1, wherein the first body has a plurality of fixing holes formed thereon and disposed corresponding to a plurality of fixtures for fixing the first body onto the wall.

5. The door hinge with a quick removal structure according to claim 1, wherein the second body has a plurality of fixing holes formed thereon and disposed corresponding to a plurality of fixtures for fixing the second body onto the door.

* * * * *